United States Patent [19]

Wilson

[11] Patent Number: 4,506,794

[45] Date of Patent: Mar. 26, 1985

[54] CHILD PROOF SAFETY CLOSURE COMBINATION OF THE TURN AND LIFT PLUG TYPE

[75] Inventor: Frank Wilson, Newmarket, Canada

[73] Assignee: Sterling Drug Inc., New York, N.Y.

[21] Appl. No.: 488,943

[22] Filed: Apr. 27, 1983

[51] Int. Cl.[3] ..... B65D 55/02; B65D 85/56; A61J 1/00

[52] U.S. Cl. ..... 215/206; 215/211

[58] Field of Search ..... 215/206, 211, 224, 223, 215/356, 357

[56] References Cited

U.S. PATENT DOCUMENTS 634,742 10/1899 Bayless ..... 215/356
3,017,049 1/1962 Powell .
3,587,896 6/1971 Graff .
3,627,160 12/1971 Horvath .
3,669,295 6/1972 Horvath .
3,896,958 7/1975 Robbins et al. .
4,043,474 8/1977 McCord .
4,238,033 12/1980 Artzt ..... 215/206

*Primary Examiner*—George T. Hall
*Attorney, Agent, or Firm*—William G. Webb; B. Woodrow Wyatt; Paul E. Dupont

[57] ABSTRACT

A child proof safety container and closure is provided in which only a minimal portion of the top of the closure element, of the plug type, is exposed, and removal is effected by upward pressure against the plug only when cooperating release means in the closure and the container are in alignment.

18 Claims, 12 Drawing Figures

FIG. 1
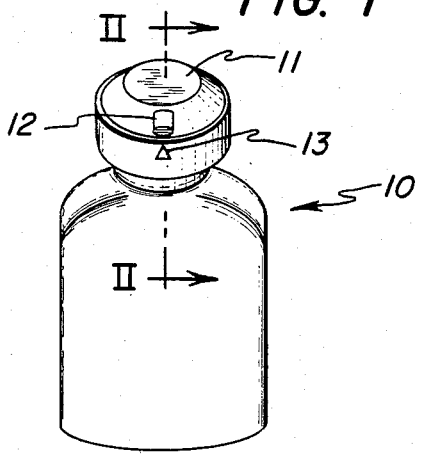
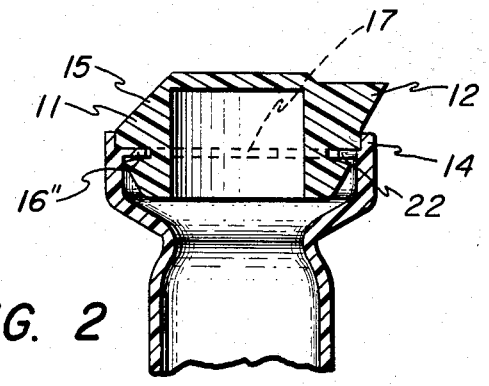
FIG. 2
FIG. 3
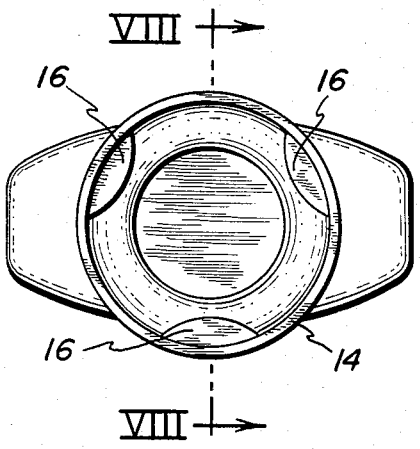
FIG. 4
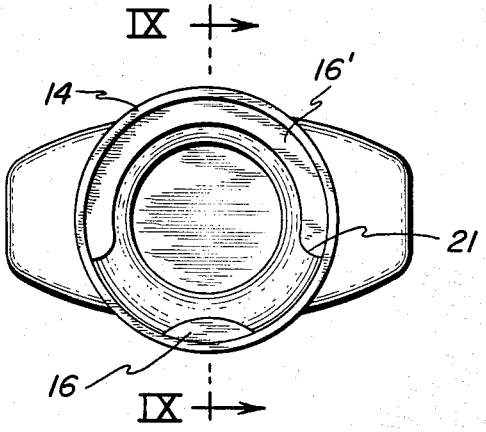
FIG. 5
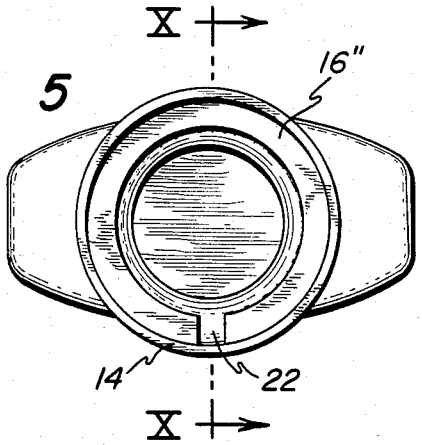

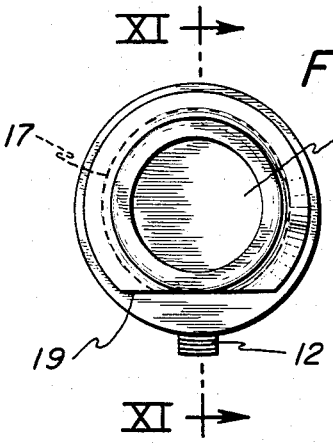
FIG. 6
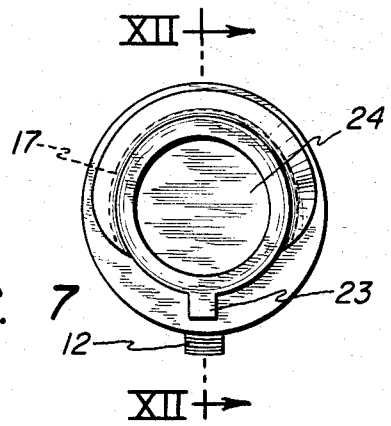
FIG. 7
FIG. 8
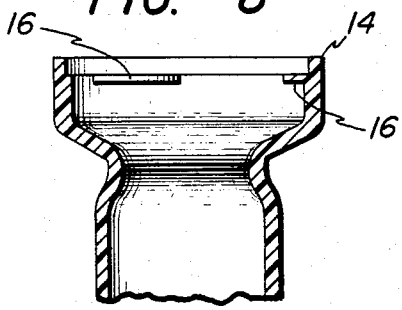
FIG. 9
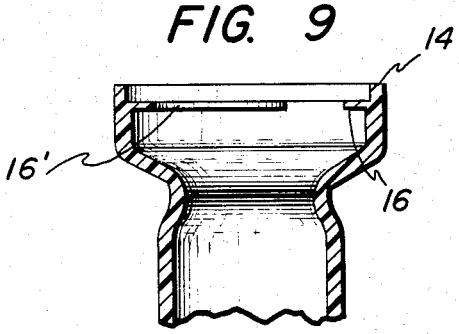
FIG. 10
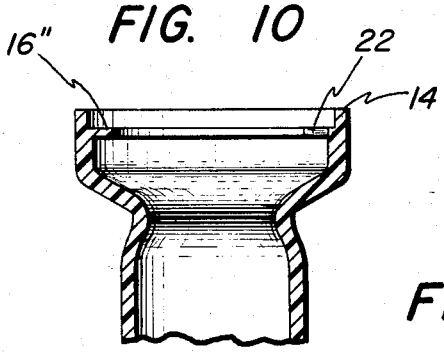
FIG. 11
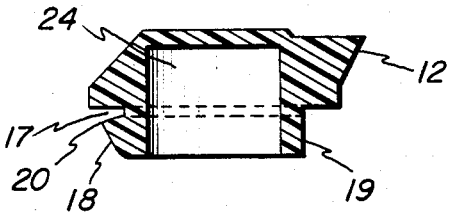
FIG. 12
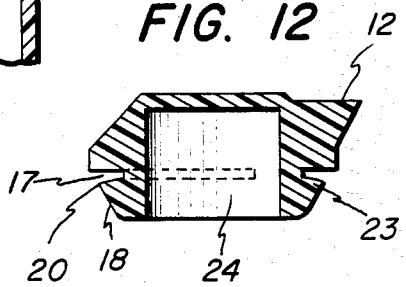

CHILD PROOF SAFETY CLOSURE COMBINATION OF THE TURN AND LIFT PLUG TYPE

(a) Field of the Invention

This invention relates to child proof safety closures for use, for example, on bottles or canisters and the like.

(b) DESCRIPTION OF THE PRIOR ART

There are a wide variety of child proof safety closures which are used primarily for sealing containers holding medicinal agents, such as tablets, capsules and the like. Such closures generally depend upon a disguised method of opening the container so that in many cases even adults would have difficulty in opening the closure, until they are either informed of the secret or until they independently work out the solution.

However many children tend naturally to be very curious and persistent, and to protect such children against access to possibly harmful drugs, it is not enough that a safety closure merely be so ingeniously designed as to defeat a child's curiosity and persistence. The closure should also be designed so that it can defeat a child's physical strength as well, because even though a child may be unable to solve the riddle of how the closure should be normally opened, he will attempt to force his way into the container by whatever means will succeed.

One of the largest classes of safety closures is the type that could be characterized as the turn-and-lift type in which a closure cap is first rotated on the bottle until separate indicia on the bottle and the closure are in alignment with one another, and the cap is then lifted from the bottle using an appropriate lifting tab. In such closures, the cap rotation step in the required opening sequence is essential in order to bring various restraint and release means, located around the periphery of the cap and the bottle, into proper registry with one another before the cap can be removed.

Typical of such turn-and-lift caps are those shown, for example, in Powell U.S. Pat. No. 3,017,049; Graff U.S. Pat. No. 3,587,896; Horvath U.S. Pat. No. 3,627,160; Horvath U.S. Pat. No. 3,669,295; Robbins et al. U.S. Pat. No. 3,896,958 and McCord U.S. Pat. No. 4,043,474. However in each of these closures, and in all others of the same general type of which I am aware, the rim of the closure cap is left exposed, so that a determined and persistent child would be able to force either his finger nails or teeth under the edge of the cap and, by physical force, pry the cap from the bottle, even against all built in restraints intended to prevent such action. Known child proof closures of the type described therefore leave room for improvement to overcome the shortcomings described above.

BRIEF SUMMARY OF THE INVENTION

The safety closures provided by this invention overcome the disadvantages, as described above, inherent in conventional safety closures of the turn-and-lift type, because their design will defeat not only a child's inventiveness in solving the proper method for opening the closures, but they will as well defeat the normal strength of a child who attempts to physically force the caps from the container. These objects are accomplished by providing a safety closure of the general turn-and-lift class in which the closure element is of the plug type, and the container is provided with an upstanding annular rim above the neck thereof which completely covers the bottom portion of the closure plug and leaves only the upper portion of the plug exposed above the edge of the rim. Access, for example by the teeth or finger-nails, to the bottom edge of the plug is thereby prevented.

BRIEF DESCRIPTION OF THE DRAWINGS

FIG. 1 is a perspective view of a bottle and safety closure plug unit according to the invention in combination.

FIG. 2 is a cross section view along section line II/II of FIG. 1 of one embodiment of the bottle and closure plug depicted in FIGS. 5 and 7.

FIGS. 3, 4 and 5 are top plan views of three different embodiments of bottles adapted for use in the practice of the invention as they would appear without the associated closure plugs.

FIGS. 6 and 7 are plan views of two embodiments of closure plugs according to the invention as viewed from the bottom.

FIGS. 8, 9 and 10 are views in cross section along section lines VIII/VIII; IX/IX and X/X of FIGS. 3, 4 and 5, respectively.

FIGS. 11 and 12 are views in cross section along section lines XI/XI and XII/XII of FIGS. 6 and 7, respectively, the plugs there depicted being shown in their right side up orientation.

DETAILED DESCRIPTION OF THE INVENTION

The invention will now be described in detail with reference to the foregoing figures, where like numerals are used to describe like parts.

FIG. 1 illustrates a bottle, identified by general reference numeral 10, having an associated closure plug 11. The closure plug is axially rotatable in the top of the bottle and is provided with a thumb tab 12. The latter serves both as an indicium for radial alignment with a second indicium 13 on the outside of the bottle near the top thereof and also as a thumb or finger bearing means for forcing the plug from the bottle when the two indicia 12/13 are in alignment.

With reference to FIG. 2, which illustrates the combination of the embodiment depicted in FIGS. 5 and 7 to be described below, it will be seen that the plug 11 is secured to the top of the bottle within an upstanding annular rim 14 above the neck of the bottle so that only the upper portion of the plug is exposed above the rim. The plug is held within the annular rim by engagement of a cooperating flange/groove means, 16/17, on the bottle and the plug, respectively, the flange being located around the inner periphery of, and at a level downward from the edge of, the annular rim.

In FIG. 2, the upper corner of the plug is shown as being chamfered slightly as at 15, although the corner may also be finished with a rounded corner. The important consideration in the nature of the edge of the plug is that, except for the tab 12, no sharp edge or corner should be provided on the exposed portion of the plug that could offer a good purchase for removal thereof.

The fundamental concept of the invention illustrated in FIGS. 1 and 2 is further illustrated by particular embodiments contemplated by the invention and represented by FIGS. 3–12. FIGS. 3, 4 and 5 show three embodiments of the bottle element provided by the invention. FIG. 6 shows, in bottom plan view, the closure plug to be used in combination with the bottle elements illustrated in FIGS. 3 and 4, while FIG. 7 shows, in bottom plan view, the closure plug to be used in combination with the bottle element illustrated in FIG. 5. Thus orientation of the plugs of FIGS. 6 and 7 with the appropriate bottles of FIGS. 3–5 is accomplished by rotating the plugs of FIGS. 6 and 7 180° about section lines XI/XI and XII/XII, respectively.

In the embodiment shown in FIGS. 3 and 6, a series of short flanges 16 around the inner wall of the upstanding annular rim 14 mate with an annular groove 17 around the mid-body section of the closure plug, this groove being best seen with reference to FIG. 11 and the flanges being best seen in FIG. 8. The lower body section of the plug is generally frustoconical in shape with an inwardly sloping wall section 18 which is interrupted by a flattened wall section 19. The plug is made of material having sufficient resilience to permit the closure plug to be snapped into the bottle opening, the flanges 16 sliding over the sloping wall section 18 and over the edge 20 thereof to thereby engage the groove 17.

The bottle indicium 13 is located on the outer face of annular rim 14 in radial alignment with one of the short flanges 16, and the thumb tab/plug indicium 12 is located in radial alignment with flattened wall section 19. Thus it will be seen that when the closure plug is oriented in the top of the bottle with the indicia 12/13, and therefore flange 16 and flattened wall section 19, out of registry with one another, the flanges will be entirely engaged with the annular groove 17, and the plug cannot be removed from the bottle. However when the plug is rotated so as to bring indicia 12/13, and cooperating release means comprising, in this embodiment, one of flanges 16 and flattened wall section 19, into registry, the flange which serves as the release means is able to move past flattened wall section 19 and thus, by upward pressure on thumb tab 12, the plug can be forced upward from the bottle.

A modification of the embodiment of FIGS. 3, 6, 8 and 11 is shown in FIGS. 4, 6, 9 and 11. In this embodiment, instead of a plurality of short flanges 16 as present in the embodiment of FIG. 3, the bottle is provided with a single short flange 16 and an extended flange 16′ which extends around a major part of the inside periphery of the upstanding annular rim 14. In the embodiment of FIG. 4, the bottle indicium 13 is located in radial alignment with the short flange 16. The corresponding plug illustrated in FIG. 6, used in combination with the embodiment of FIG. 4, is fitted to, and removed from, the bottle in the same manner as described before with reference to FIGS. 3 and 6. However, in order to facilitate removal of the plug when short flange 16 and flattened wall section 19 are in registry, it is desirable to provide slightly rounded ends 21 to the extended flange 16′ in order to permit the latter to more readily disengage from groove 17 as the plug is moved upward.

A further embodiment of the invention is illustrated in FIGS. 5, 7, 10 and 12. In this embodiment, a continuous flange 16″ interrupted by a short gap 22 is provided around the inner periphery of annular rim 14. The mating plug, shown in FIGS. 7 and 12, is provided with an annular groove 17 for engagement with flange 16″, but in this embodiment the frustoconical lower end of the plug which forms the inwardly sloping wall section 19 of the plug is cut away so that the groove 17 subtends a shorter arc of the plug periphery than that subtended by the embodiment of FIG. 6. The plug is further provided with a lug 23 in radial alignment with indicium/thumb tab 12, the lug being of such width that it can pass through gap 22. The closure plug is attached to, or removed from, the bottle in the same manner previously described, rotation of the plug to bring indicia 12/13 into alignment also bringing the cooperating release means, lug 23 and gap 22, into alignment with one another, so that by upward pressure on the thumb tab 12, the lug can pass through gap 22 permitting removal of the plug. The removal can be facilitated by providing slightly rounded edges on the ends of the sloping wall at the termination points of the groove to permit more ready disengagement of the flange 16″ from the groove 17.

The closure plugs used in the practice of the invention are illustrated in the drawings with a hollow space 24 within the plug. This hollow space performs no critical function in the use of the plugs and is used only in the interest of economy of material. Thus solid plugs, having the proper resilience, will serve as well in the practice of the invention, and such solid plugs are therefore considered to be within the purview of the invention.

The bottles and the closure plugs provided by the invention are manufactured of materials conventionally used in this art. Thus the bottles can be fabricated of glass or of various plastic materials such as polystyrene, polyethylene or polypropylene, and the like, and the plugs can be fabricated of a variety of plastic materials, including vinyl rubbers, polyethylene, polypropylene and the like.

Having thus described the invention and the advantages thereof, it is considered that the invention is to be broadly construed and limited only by the character of the following claims.

I claim:

1. A child proof closure/container combination comprising:

A. a bottle having an upstanding annular rim above the neck thereof, said annular rim being provided with flange means arranged around the inner periphery, and at a level downward from the edge, thereof; and B. a closure plug for insertion within said upstanding annular rim so as to thereby leave only the upper portion of said plug exposed above the edge of said annular rim, said plug having an annular groove therein for engagement with said flange means, said container and plug being provided with cooperating release means, whereby said plug is removable by upward force thereagainst, from said container only when said cooperating release means are in radial alignment with one another.

2. The combination according to claim 1 wherein said flange means comprises a plurality of short flanges or an extended flange and wherein said release means comprises a short flange within said annular rim for cooperation with a flattened portion of a frustoconical section on the lower portion of said plug.

3. The combination according to claim 2 wherein said flange means comprises a plurality of short flanges.

4. The combination according to claim 2 wherein said flange means comprises an extended flange.

5. The combination according to claim 1 wherein said flange means comprises a continuous flange, and wherein said release means comprises a gap in said flange for cooperation with a lug on the lower portion of said plug.

6. The combination according to claim 3 having indicia on said annular rim and said plug for radial alignment of the same and for removal of said plug.

7. The combination according to claim 4 having indicia on said annular rim and said plug for radial alignment of the same and for removal of said plug.

8. The combination according to claim 5 having indicia on said annular rim and said plug for radial alignment of the same and for removal of said plug.

9. A container for use in combination with a child-proof closure of the plug type, said container having an upstanding annular rim above the neck thereof, said annular rim being provided with flange means for engagement with, and for provision of release means for, said associated plug, said flange means being arranged around the inner periphery of, and at a level downward from, the edge of said annular rim wherein said plug is engageable with said flange means in any radially angular orientation of said plug relative to the opening of said container and is freely axially rotatable within the opening of said container when engaged therewith.

10. A container according to claim 9 wherein said flange means comprises a plurality of short flanges or an extended flange and said release means comprises a short flange.

11. A container according to claim 9 wherein said flange means comprises a continuous flange and said release means comprises a gap in said continuous flange.

12. A container according to claim 10 which includes an indicium on the outer wall of said annular rim in radial alignment with one of said short flanges.

13. A container according to claim 11 which includes an indicium on the outer wall of said annular rim in radial alignment with said gap.

14. A closure plug for use in combination with a child proof container whereby only the upper portion of said plug is exposed above the edge of an upstanding annular rim of said associated container, said plug being provided with: (A) an annular groove for interengagement with flange means within said annular rim; and (B) release means, whereby said plug is removable by upward force from said container when said release means is in radial alignment with cooperating release means on said container.

15. A closure plug according to claim 14 wherein said annular groove is adapted for interengagement with a plurality of short flanges or an extended flange and wherein said release means is adapted for cooperation with a short flange within said annular rim.

16. A closure plug according to claim 14 wherein said annular groove is adapted for interengagement with a continuous flange, and wherein said release means comprises a lug for cooperation with a gap in said flange.

17. A closure plug according to claim 15 which includes an indicium on said plug in radial alignment with said release means.

18. A closure plug according to claim 16 which includes an indicium on said plug in radial alignment with said release means.

* * * * *